US008827259B2

(12) United States Patent
Fujii et al.

(10) Patent No.: US 8,827,259 B2
(45) Date of Patent: Sep. 9, 2014

(54) IMAGE FORMING APPARATUS

(75) Inventors: Ikuo Fujii, Osaka (JP); Takamitsu Ikematsu, Osaka (JP); Ippei Kimura, Osaka (JP); Kaoru Tada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/571,825

(22) Filed: Aug. 10, 2012

(65) Prior Publication Data

US 2013/0043647 A1 Feb. 21, 2013

(30) Foreign Application Priority Data

Aug. 17, 2011 (JP) ..... 2011-178439

(51) Int. Cl.
*B65H 5/00* (2006.01)

(52) U.S. Cl.
USPC ..... 271/10.03; 271/10.02; 271/110

(58) Field of Classification Search
USPC ..... 271/10.02, 10.03, 110, 10.01
See application file for complete search history.

(56) References Cited

U.S. PATENT DOCUMENTS

| | | | | |
|---|---|---|---|---|
| 5,423,527 | A * | 6/1995 | Tranquilla | 271/10.02 |
| 5,580,046 | A * | 12/1996 | Beaufort et al. | 271/3.16 |
| 6,076,821 | A * | 6/2000 | Embry et al. | 271/10.01 |
| 7,068,969 | B2 * | 6/2006 | Ueda | 399/388 |
| 7,275,740 | B2 * | 10/2007 | Able et al. | 271/10.01 |
| 7,722,026 | B2 * | 5/2010 | Hirate et al. | 271/10.02 |
| 7,896,337 | B2 * | 3/2011 | Kumadaki | 271/10.04 |
| 7,900,917 | B2 * | 3/2011 | Fujiwara et al. | 271/265.04 |
| 8,465,015 | B2 * | 6/2013 | Fujiwara et al. | 271/10.03 |
| 2010/0019440 | A1 * | 1/2010 | Fujiwara et al. | 271/10.02 |
| 2012/0248677 | A1 * | 10/2012 | Nakamura et al. | 271/3.18 |

FOREIGN PATENT DOCUMENTS

| | | |
|---|---|---|
| JP | 10-194529 | 7/1998 |
| JP | 2001-348129 | 12/2001 |
| JP | 2004-045980 | 2/2004 |
| JP | 2007-121885 | 5/2007 |
| JP | 2008-013338 | 1/2008 |

* cited by examiner

*Primary Examiner* — Kaitlin Joerger
(74) *Attorney, Agent, or Firm* — Harness, Dickey & Pierce, P.L.C.

(57) ABSTRACT

An image forming apparatus includes an image forming unit to form an image on a sheet-shaped recording medium; a registration roller pair to convey the recording medium to the image forming unit; a sheet feed roller to convey the recording medium to the registration roller pair; and a controller to control driving of the registration roller pair and the sheet feed roller. In such an image forming apparatus, the controller starts driving of the sheet feed roller to feed the recording medium and stops driving of the sheet feed roller before the sheet feed roller has completed conveyance of the recording medium for a distance equal to a length of the settable minimum-sized recording medium in the conveyance direction.

10 Claims, 14 Drawing Sheets

IMAGE FORMING APPARATUS

CROSS-REFERENCE TO RELATED APPLICATION

The present application claims priority from Japanese patent application number 2011-178439, filed on Aug. 17, 2011, the entire contents of which are incorporated by reference herein.

BACKGROUND OF THE INVENTION

1. Field of the Invention

The present invention relates to an image forming apparatus such as a copier, a printer, a facsimile machine, or a multi-function apparatus having one or more capabilities of the above devices.

2. Description of the Related Art

In an image forming apparatus such as a copier, a printer, a facsimile machine, or a multi-function apparatus having one or more capabilities of the above devices, an image forming unit included in the image forming apparatus forms an image on a medium, such as a sheet, based on image data input from a scanner or an external personal computer. In this case, a sheet of a size corresponding to the input image data is normally fed from a sheet feed unit to the image forming unit.

However, when a sheet having a shorter size in the sheet conveyance direction than a desired size is set in the sheet feed unit, it can happen that two shorter-sized sheets are conveyed successively. When two shorter-sized sheets are conveyed continuously, the image to be formed on one larger-sized sheet is formed crossing the boundaries of the two shorter-sized sheets, and therefore, a toner image may be transferred starting from a leading end of the second sheet.

Normally, in an image forming apparatus employing a thermal fixing method in which the toner image is thermally fixed by using, for example, a fixing roller, part of the leading end of the sheet is a margin where the toner image is not transferred. Because the marginal part does not exert an adhesive force on the toner, separability of the sheet with respect to the fixing roller is assured. However, as a result of the two shorter-sized sheets being conveyed continuously, if the toner image is transferred from the leading end of the second sheet, the second sheet is not cleanly separated from but is instead wound around the fixing roller.

To cope with the above problem, JP-2007-121885-A, for example, discloses an image forming apparatus configured to temporarily stop a sheet feed roller immediately after the sheet has been conveyed up to half the length thereof set by the user in the conveyance direction, and thereafter, rotate the sheet feed roller again to convey the sheet. By thus controlling driving of the sheet feed roller, even though the length in the conveyance direction of the set-sheet is only half the length in the conveyance direction of the sheet to be originally set, a gap may be formed between a first sheet and a second sheet, thereby preventing two sheets being conveyed continuously without any space in between. By detecting the gap with a sensor, the image forming apparatus can recognize that two small-sized sheets have been conveyed continuously.

According to the method disclosed by JP-2007-121885-A, when the length in the conveyance direction of the erroneously-set sheet is half or less than half the length in the conveyance direction of the sheet to be originally set, a gap may be formed between the first sheet and the second sheet. However, when the length in the conveyance direction of the erroneously-set sheet is longer than half that of the sheet to be originally set, a gap may not be formed between the first sheet and the second sheet. Accordingly, there is such a problem that the continuous feeding of the erroneously set sheets cannot be detected. For example, when A3-sized sheets should have been set with its longer side along the sheet conveyance direction, assume that B4-sized sheets are instead mistakenly set with its longer side along the sheet conveyance direction. In this case, because the longer side of the B4-sized sheet is longer than half the longer side length of the A3-sized sheet, the erroneous setting can not be detected.

Even in this case, if a side fence capable of detecting a shorter side of the set-sheet is provided, the erroneous setting can be detected from the difference between the shorter-side length of the A3-sized sheet and that of the B4-sized sheet. However, provision of the side fence as a detection means to the sheet feed increases costs and makes the apparatus larger, and thus is not a practical option for low-end printers facing fierce cost competition.

Further, when using the usual contact-type feeler (swing lever common to small printers to detect a gap between the first and the second sheets, a 15 to 20 mm gap is required between sheets so that the feeler detects the gap between sheets. In order to secure that gap, the leading end of the sheet needs to have a bending portion longer than 2 to 4 mm for the normal sheet so as to align the conveyed sheet to be straight. As a result, the bending portion of the sheet interferes with conveyance guides to cause abnormal noise or damage such as creasing of the sheet. When using a thick sheet having greater rigidity, even though the sheet is controlled to be conveyed to have a larger bending amount, the sheet feed roller slips due to the rigidity of the sheet and the bending amount does not increase.

BRIEF SUMMARY OF THE INVENTION

Considering the above problems, the present invention provides an optimal image forming apparatus in which even though the length of the conveyance direction of the actually conveyed sheet is longer than half that of the to-be-conveyed sheet, continuous conveyance of the two sheets is prevented, with a small footprint and at low cost.

In particular, the optimal image forming apparatus includes an image forming unit to form an image on a sheet-shaped recording medium; a registration roller pair to convey the recording medium to the image forming unit; a sheet feed roller to convey the recording medium to the registration roller pair; and a controller to control driving of the registration roller pair and the sheet feed roller. In such an image forming apparatus, the controller starts driving of the sheet feed roller to feed the recording medium and to stop driving of the sheet feed roller before the sheet feed roller has completed conveyance of a length of the settable minimum-sized recording medium in the conveyance direction.

These and other objects, features, and advantages of the present invention will become more readily apparent upon consideration of the following description of the preferred embodiments of the present invention when taken in conjunction with the accompanying drawings.

DETAILED DESCRIPTION OF THE INVENTION

Figure 1:
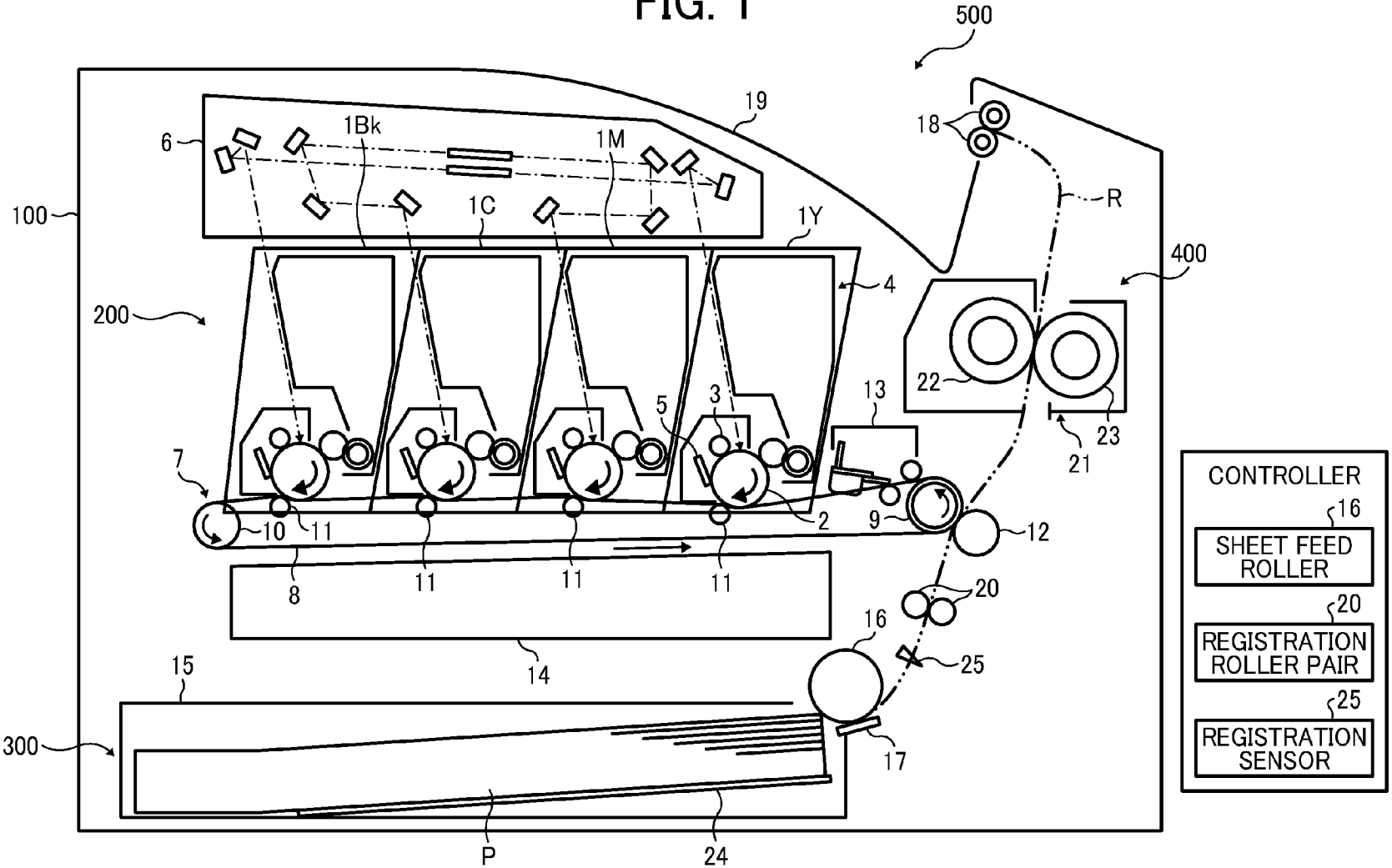
FIG. 1 shows a schematic view of an image forming apparatus according to an embodiment of the present invention.

Hereinafter, preferred embodiments of the present invention will now be described with reference to accompanying drawings. In each figure illustrating the present invention, a part or component having the same function or shape is given the same reference numeral, and once described, a redundant description thereof will be emitted.

First, with reference to FIG. 1, the overall structure and operation of a color laser printer as an image forming apparatus according to embodiments of the present invention will be described.

A printer as illustrated in FIG. 1 includes an image forming unit 200 to form an image on a sheet of paper recording media; a sheet feed unit (or a recording medium supplier) 300 to supply a sheet to the image forming unit 200; a fixing unit 400 to fix an image formed on the sheet by the image forming unit 200, onto the sheet; and an ejection unit (or a recording medium ejection unit) 500 to eject the sheet on which the image is fixed by the fixing unit 400 to outside the apparatus.

The image forming unit 200 includes four process units 1Y, 1M, 1C, and 1Bk; an exposure unit 6; and a transfer unit 7. Four process units 1Y, 1M, 1C, and 1Bk each are detachably attached to a printer body 100. Each of the process units 1Y, 1M, 1C, and 1Bk has the same structure except that each includes a different color of toner such as yellow (Y), magenta (M), cyan (C), and black (Bk) that corresponds to RGB color separation component of a color image.

Specifically, each process unit 1Y, 1M, 1C, or 1Bk includes a drum-shaped photoreceptor 2 as a latent image carrier on which an electrostatic latent image is carried; a charger including a charging roller 3 to charge a surface of the photoreceptor 2; a developing device 4 to supply toner as a developer to the electrostatic latent image on the photoreceptor 2; and a cleaning unit including a cleaning blade 5 to clean the surface of the photoreceptor 2. In FIG. 1, reference numerals are applied to those parts included in the process unit 1Y for yellow, that is, the photoreceptor 2, the charging roller 3, the developing device 4, and the cleaning blade 5 are each applied with a reference numeral, and the parts corresponding to the other process units 1M, 1C, and 1Bk are not supplied with reference numerals.

As illustrated in FIG. 1, an exposure unit 6 is disposed above each of the process units 1Y, 1M, 1C, and 1Bk. The exposure unit 6 includes a light source, a polygonal minor, an fθ lens, a reflection mirror, and the like, and is configured to scan the surface of each photoreceptor 2 included in each of the process units 1Y, 1M, 1C, and 1Bk with beams of light based on image data.

The transfer device 7 is disposed underneath each of the process units 1Y, 1M, 1C, and 1Bk. The transfer device 7 includes an intermediate transfer belt 8 stretched over a plurality of rollers; four primary transfer rollers 11 as primary transfer means; and a secondary transfer roller 12 as a secondary transfer means. The intermediate transfer belt 8 is constituted of an endless belt. Herein, the intermediate transfer belt 8 is stretched over a drive roller 9 being a support member and a driven roller 10. When the drive roller 9 rotates in the counterclockwise direction as shown in the figure, the intermediate transfer belt 8 is driven to rotate in a direction as indicated by an arrow in the figure.

The four primary transfer rollers 11 each are disposed at a position opposed to the photoreceptor 2 via the intermediate transfer belt 8. Each primary transfer roller 11 presses an interior surface of the intermediate transfer belt 8 at each disposed position, and a primary transfer nip is formed at a position where the pressed portion of the intermediate transfer belt 8 contacts each photoreceptor 2. In addition, each primary transfer roller 11 is connected with a power source, not shown, and is supplied with a predetermined direct current voltage (DC) and/or alternating current voltage (AC).

The secondary transfer roller 12 is disposed at a position opposed to the drive roller 9 via the intermediate transfer belt 8. The secondary transfer roller 12 presses an external surface of the intermediate transfer belt 8 and a secondary transfer nip is formed at a position where the secondary transfer roller 12 contacts the intermediate transfer belt 8. In addition, similarly to the primary transfer rollers 11, the secondary transfer roller 12 is connected with a power source, not shown, and is supplied with a predetermined direct current voltage (DC) and/or alternating current voltage (AC).

A belt cleaning unit 13 configured to clean the surface of the intermediate transfer belt 8 is disposed at a peripheral surface of the intermediate transfer belt 8, that is, the upper right in the figure. A waste toner conveying hose, not shown, is extended from the belt cleaning unit 13 and is connected with an inlet port of the waste toner container 14 disposed below the transfer device 7.

The sheet feed unit 300 disposed below the apparatus body 100 includes a sheet feed cassette 15, a container in which a sheet P is contained; a sheet feed roller 16, a feeding means to feed a sheet from the sheet feed cassette 15; and a friction pad 17, which is a separation means to separate sheets one by one from a plurality of sheets fed by the sheet feed roller 16. The sheet feed cassette 15 includes a bottom plate 24 on which the sheet P is placed. The bottom plate 24 is pressed by a biasing means, not shown, toward the sheet feed roller 16. With this structure, a topmost sheet among the sheets stacked on the bottom plate 24 is held in contact with the sheet feed roller 16.

A sheet ejection roller pair 18 to eject the sheet outside the apparatus and a sheet ejection tray 19 to stock the sheet ejected outside the apparatus are disposed at the ejection unit 500 disposed above the apparatus body 100.

In addition, a conveyance path R is a path through which the sheet is conveyed from the sheet feed unit 300 to the ejection unit 500 via the secondary transfer nip inside the apparatus body 100. In the conveyance path R, a registration roller pair 20 is disposed upstream in the sheet conveyance direction of the secondary transfer roller 12. The registration roller pair 20 serves as a conveyance means to convey the sheet to the secondary transfer nip. A registration sensor 25 serving as a detecting means to detect the sheet is disposed in the conveyance path R between the registration roller pair 20 and the sheet feed roller 16. The registration sensor 25 may be either a contact-type, swingably disposed feeler or a non-contact-type, transmissive or reflective optical sensor.

The fixing device 21 is disposed at the fixing unit 400 upstream in the sheet conveyance direction of the secondary transfer roller 12 in the conveyance path R. The fixing device 21 includes a fixing roller 22 serving as a fixing member to fix the toner image onto the sheet and a pressure roller 23 serving as a pressing member to form a fixing nip by pressing against the fixing roller 22. A built-in heater, not shown, is disposed inside the fixing roller 22 serving as a heating means to heat the fixing roller 22.

The printer as illustrated in FIG. 1 operates as described below.

When an image forming operation is started, each photoreceptor 2 of each of the process units 1Y, 1M, 1C, and 1Bk is driven to rotate in the clockwise direction as illustrated in FIG. 1, and each surface of the photoreceptor 2 is uniformly charged to a predetermined polarity by the charging roller 3. Based on the image data read by an image scanner, not shown, the exposure unit 6 irradiates the charged surface of each photoreceptor 2 with light beams to form an electrostatic latent image on the surface of each photoreceptor 2. In this case, the image data exposed on each photoreceptor 2 is monochrome image data decomposed from the full-color image into color data of yellow, magenta, cyan, and black. Each developing device 4 supplies toner to the electrostatic latent image formed on the photoreceptor 2, and the electrostatic latent image is then render visible as a toner image.

Subsequently, the drive roller 9 that is stretched over the intermediate transfer belt 8 is driven to rotate to thus cause the intermediate transfer belt 8 to rotate in the direction indicated by an arrow in FIG. 1. In addition, because a constant voltage or a voltage controlled to have a constant current with a polarity opposite that of the toner is applied to each of the primary transfer rollers 11, a transfer electric field is formed in the primary transfer nip between each of the primary transfer rollers 11 and each photoreceptor 2. The toner image of each color formed on each photoreceptor 2 is sequentially transferred in a superimposed manner on the intermediate transfer belt 8 by the transfer electric field formed in the primary transfer nip. With this operation, a full-color toner image is formed on the surface of the intermediate transfer belt 8. In addition, toner that has not been transferred to the intermediate transfer belt 8 but remains on each photoreceptor 2 is removed by the cleaning blade 5.

On the other hand, the sheet feed roller 16 of the sheet feed unit 300 starts rotation and the sheets P contained in the sheet feed cassette 15 are separated one by one by a collaborative action of the sheet feed roller 16 and the friction pad 17 contacting the sheet feed roller 16, and a single sheet P is conveyed to the conveyance path R. The sheet P fed toward the conveyance path R abuts the registration roller pair 20, skew of the sheet is corrected, and thereafter, the registration roller pair 20 starts driving at a predetermined timing so that the sheet P is conveyed to the secondary transfer nip formed between the secondary transfer roller 12 and the intermediate transfer belt 8.

In this case, because the transfer voltage having a polarity opposite that of the charged toner of the toner image on the intermediate transfer belt 8 is applied to the secondary transfer roller 12, a transfer electric field is formed at the secondary transfer nip. Via the electric transfer field formed at the secondary transfer nip, the toner image on the intermediate transfer belt 8 is secondarily transferred en bloc to the sheet P that has been conveyed to the secondary transfer nip. In addition, the toner that has not been transferred to the intermediate transfer belt 8 but remains on each photoreceptor 8 is removed by the belt cleaning unit 13 and is conveyed to and collected in a waste toner container 14.

As described above, the sheet P on which the toner image has been transferred en bloc in the secondary transfer nip, is then conveyed to the fixing device 21. Then, the sheet P is fed to a fixing nip between the fixing roller 22 and the pressure roller 23, in which the sheet P is heated and pressurized, so that the toner image is fixed onto the sheet P. Thereafter, the sheet P that has been fed by the rotating fixing roller 22 and pressure roller 23 is ejected outside the apparatus and is stacked on the sheet ejection tray 19.

The description heretofore relates to an image forming operation when a full-color image is formed on the recording medium; however, a monochrome image may be formed using any one of the four process units 1Y, 1M, 1C, and 1Bk and an image formed of two or three colors may be possible by using two or three process units.

Next, a normal sheet feed operation will now be described with reference to FIGS. 2A to 2E and 3. FIGS. 2A to 2E are views illustrating how a sheet is fed in the normal sheet feed operation and FIG. 3 is a timing chart illustrating how each of the sheet feed roller and the registration roller pair rotates in the normal sheet feed operation.

Figure 2A:
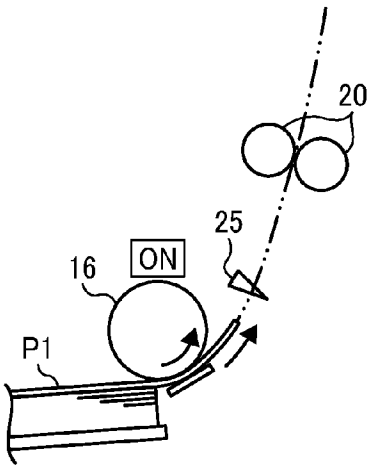
FIGS. 2A to 2E are views illustrating how a sheet is fed in a normal sheet feed operation.
Figure 2B:
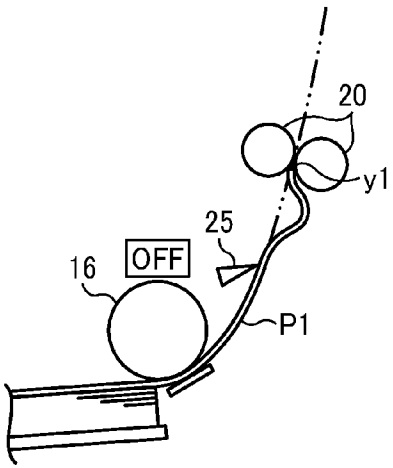
Figure 3:
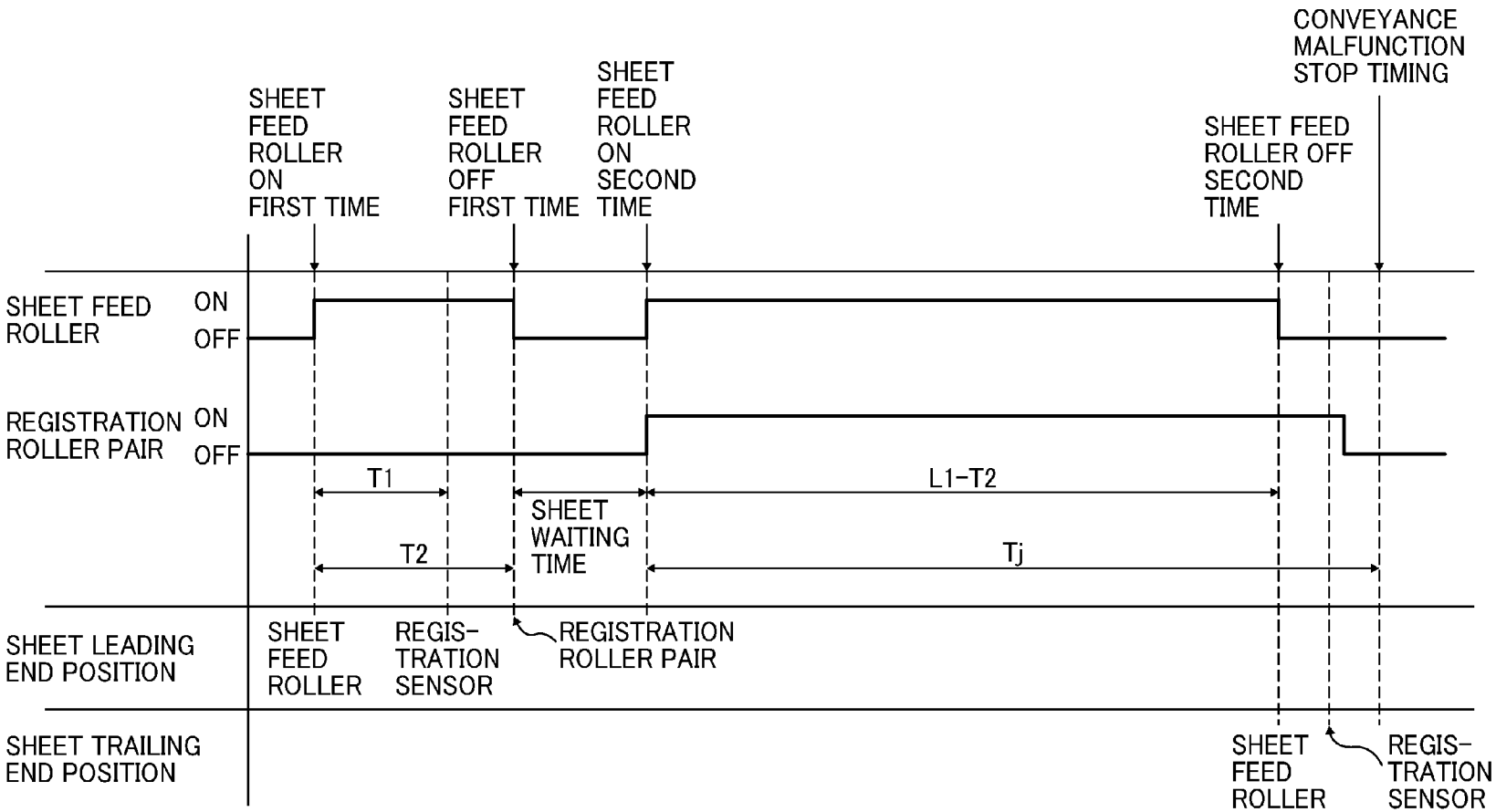
FIG. 3 is a timing chart illustrating how each of a sheet feed roller and a registration roller pair rotates in the normal sheet feed operation.

Upon receiving a sheet feed instruction, the sheet feed roller 16 is driven to rotate and a topmost sheet P1 is fed out as illustrated in FIG. 2A. Then, as illustrated in FIG. 2B, a leading end y1 of the fed-out sheet P1 passes through a sensor position of the registration sensor 25, contacts a nip portion of the registration roller pair 20, a bend is formed at the leading end y1, and a rotation of the sheet feed roller 16 is temporarily stopped.

Figure 6:
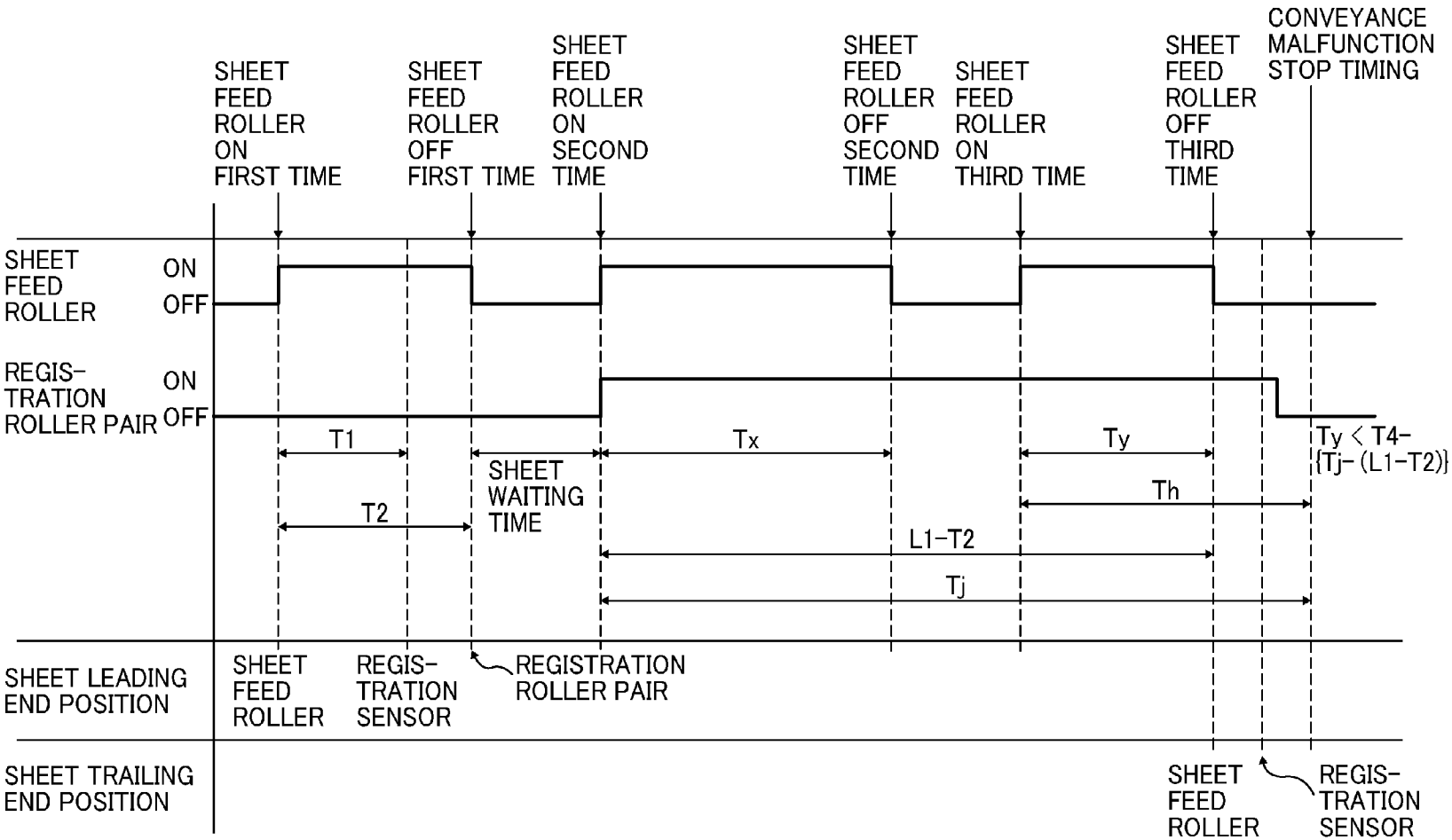
FIG. 6 is a timing chart illustrating how each of the sheet feed roller and the registration roller pair rotates in the sheet feed operation preventing continuous feeding of the erroneously-set sheet.
Figure 8:
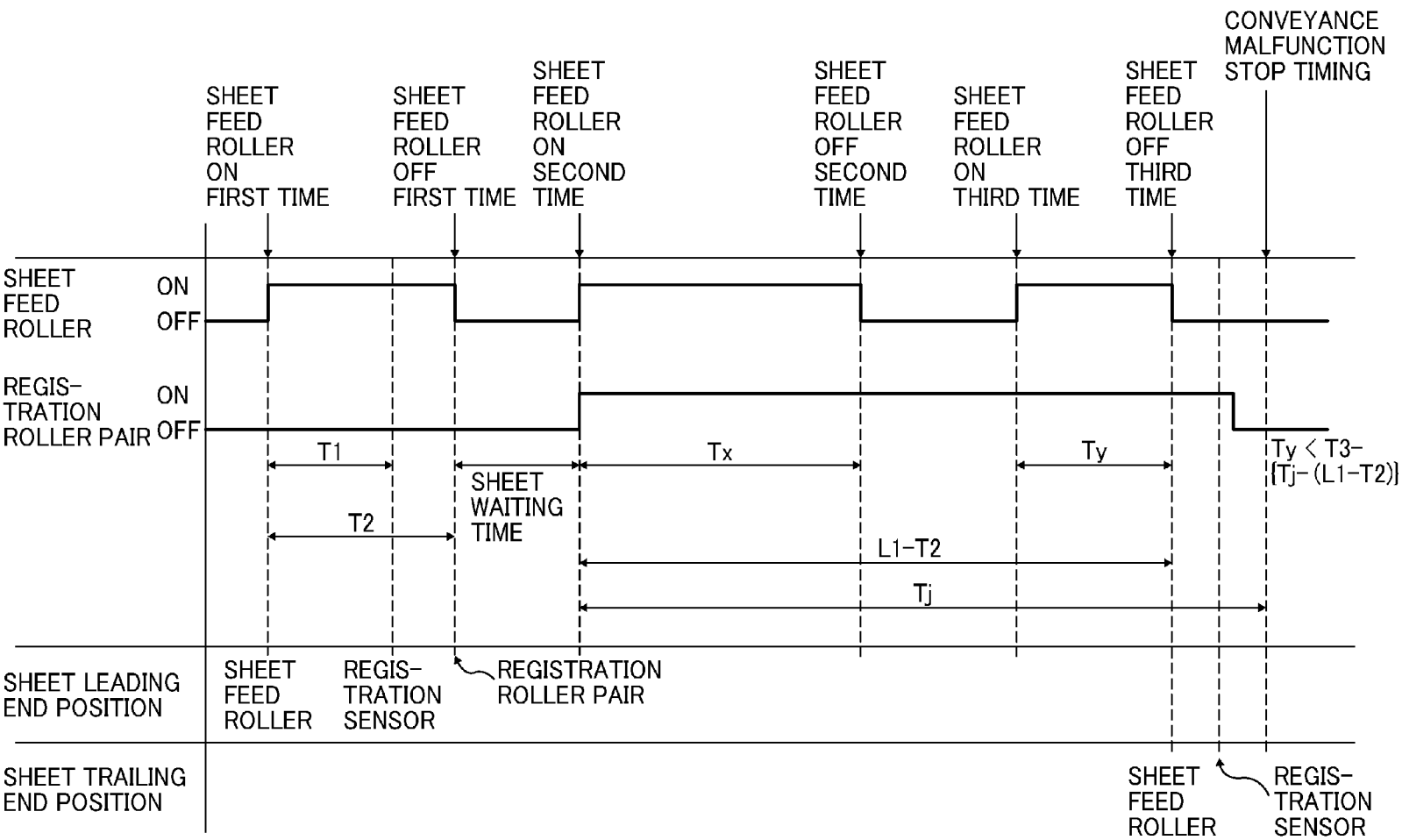
FIG. 8 is a timing chart illustrating a third type of rotation of the sheet feed roller and the registration roller pair in the sheet feed operation preventing continuous feeding of the erroneously-set sheet.
Figure 10:
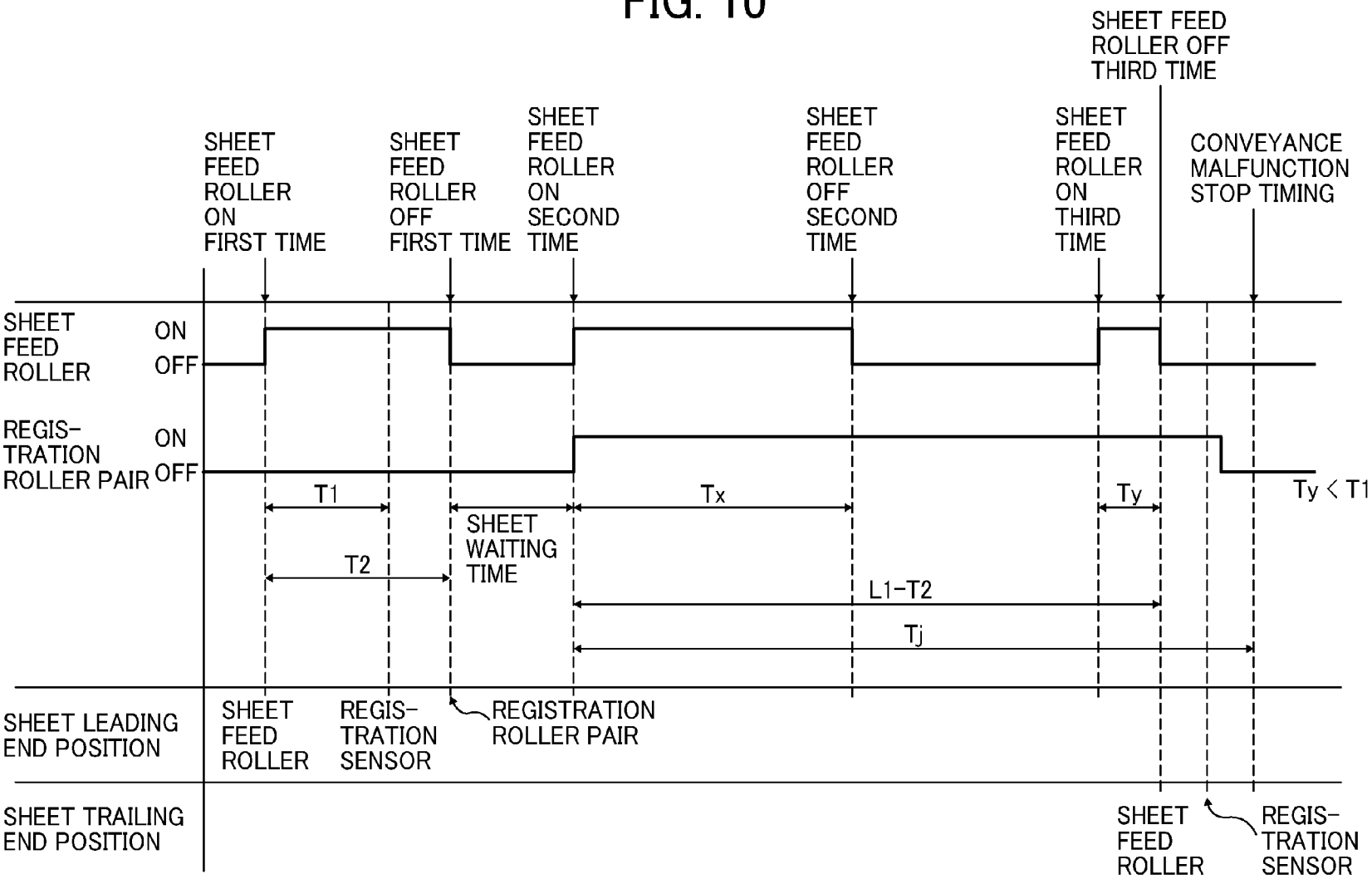
FIG. 10 is a timing chart illustrating a third type of rotation of the sheet feed roller and the registration roller pair in the sheet feed operation preventing continuous feeding of the erroneously-set sheet.

In actuality, the sheet feed roller 16 is slightly moved even after the leading end of the sheet P1 abuts the registration roller pair 20 so as to correct the skew of the sheet. For simplicity, in FIG. 3, driving of the sheet feed roller is represented as stopped at a time when the leading end of the sheet abuts the registration roller pair (see a first time of the sheet feed roller OFF in FIG. 3). It is to be noted that timing charts as illustrated in FIGS. 6, 8, and 10 are also similarly simplified.

Figure 2C:
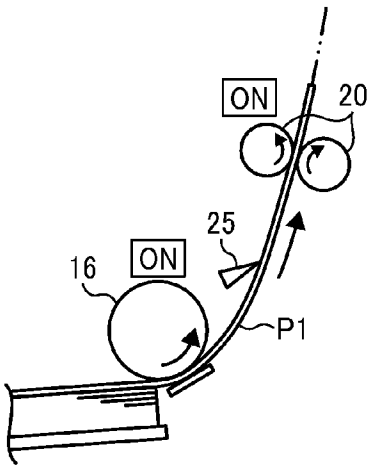
Figure 2D:
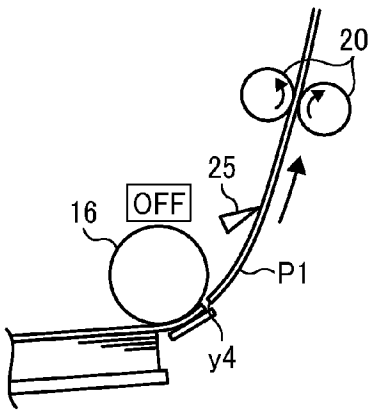

Then, as illustrated in FIG. 2C, the registration roller pair 20 is rotated at a predetermined timing and the rotation of the sheet feed roller 16 is restarted simultaneously, so that the sheet P1 is conveyed downstream. Then, as illustrated in FIG. 2D, at a time when a trailing end y4 of the sheet P1 passes the sheet feed roller 16, driving of the sheet feed roller 16 is stopped. Herein, the timing when the trailing end y4 of the sheet P1 passes through the sheet feed roller 16 is set to a timing when the sheet feed roller 16 has conveyed the sheet P by a length in the conveyance direction of the sheet having a corresponding sheet size based on the image data input from a scanner or an external personal computer.

Figure 2E:
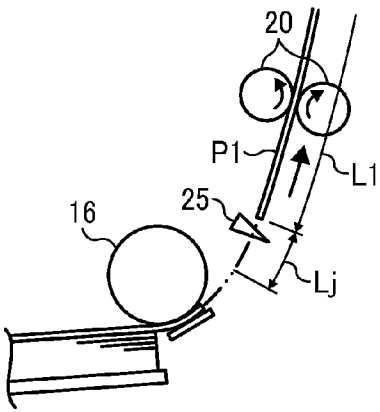

Then, as illustrated in FIG. 2E, when the registration sensor 25 detects the trailing end y4 of the sheet P1 by a predetermined timing, it is determined that the feeding operation is correctly performed and the sheet feed operation by the registration roller pair 20 continues. In this case, the sheet P1 is sequentially conveyed via the secondary transfer nip and the fixing device, and after the image has been transferred and fixed, the sheet P1 is ejected outside the apparatus. In addition, the rotation of the registration roller pair 20 is stopped at a time when the trailing end of the sheet passes through the nip portion of the registration roller pair 20.

On the other hand, when the sheet trailing end is not detected before a predetermined time has elapsed, it is determined that a malfunction has occurred in the conveyance such as sheet jamming. In this case, conveyance of the sheet is forcibly stopped to reduce any damage to the apparatus as a result of abnormal conveyance.

A predetermined timing as a basis for determination whether occurs conveyance malfunction has occurred or not is set, as illustrated in FIG. 2E, as a time equal to the time required for a sheet P1 having a given length in the conveyance direction to pass through the detection position of the registration sensor 25 plus an allowance time equivalent to an allowance length Lj. The allowance length Lj is determined taking into account any delay that might occur if the sheet slips during the conveyance. Whether the sheet has passed or not within the timing set as the determination basis is recognized by measuring a predetermined time from the sheet feed start time or from a predetermined timing thereafter. In the timing chart as illustrated in FIG. 3, the timing as the determination basis is obtained by measuring a predetermined time Tj from the start of driving of the registration roller pair. Determination of a conveyance malfunction and controlling of the sheet feed roller, registration rollers, registration sensor, and the like, are performed by a controller, not shown, included in the printer.

The normal sheet feed operation has been described heretofore. When starting the sheet feed operation, however, if a smaller-sized sheet different from the to-be-set sheet originally is set, it can happen that two pieces of smaller-sized sheets are continuously conveyed in a sheet feed operation instead of a single sheet as in the conventional case.

Even in such a case, if the length of the sheet in the conveyance direction corresponding to two pieces of smaller-sized sheet exceeds the above length in the conveyance direction set as the determination basis of the conveyance malfunction, that is, the length of the conveyance direction of the sheet plus an allowance length of Lj as illustrated in FIG. 2E, it is determined that a conveyance malfunction has occurred and the sheet conveyance is stopped. However, if the length of the sheet conveyance direction corresponding to two pieces of smaller-sized sheet is below the length in the conveyance direction set as the determination basis of the conveyance malfunction, it is not determined that a conveyance malfunction has occurred and the two smaller-sized sheets are continuously conveyed to the transfer unit or the secondary transfer nip. As a result, if the toner image is transferred from the leading end of the second sheet, the second sheet might be wound around the fixing roller.

The following sheet feed operation is embodied in the present invention to prevent continuous sheet feeding of the erroneously set sheet.

FIGS. 4A to 4F show how a correct-size sheet is fed in a sheet feed operation preventing continuous feeding of the erroneously-set sheet; FIGS. 5A to 5G show how a different-size sheet is fed in the sheet feed operation preventing continuous feeding of the erroneously-set sheet; and FIG. 6 is a timing chart illustrating how each of the sheet feed roller and the registration roller pair drives in the sheet feed operation preventing continuous feeding of the erroneously-set sheet.

First, with reference to FIGS. 4A to 4F and FIG. 6, a sheet feed operation when a correct-size sheet is set will be described.

Figure 4A:
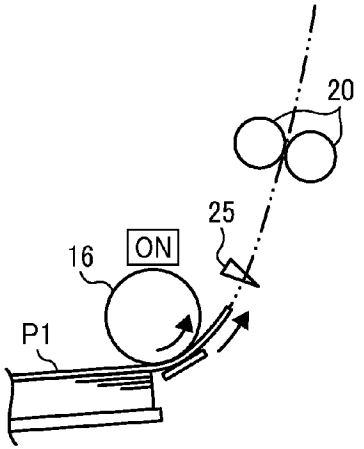
FIGS. 4A to 4F show how a correct-size sheet is fed in a sheet feed operation preventing continuous feeding of an erroneously-set sheet.
Figure 4B:
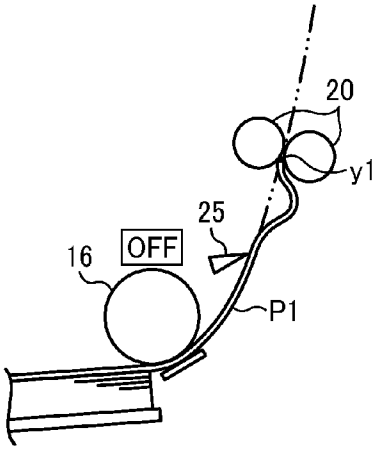
Figure 4C:
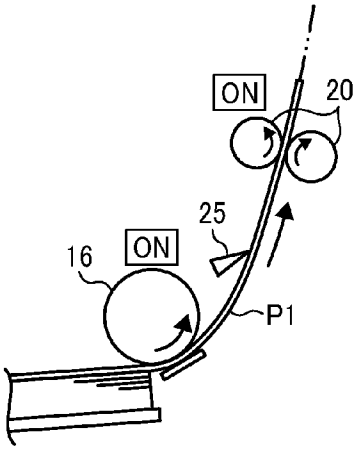

Upon receiving a sheet feed instruction, the sheet feed roller 16 is driven to rotate and a topmost sheet P1 is fed out as illustrated in FIG. 4A. Then, as illustrated in FIG. 4B, a leading end y1 of the fed-out sheet P1 passes through a detection position of the registration sensor 25, contacts a nip portion of the registration roller pair 20, a bending is formed at the leading end y1, and a rotation of the sheet feed roller 16 is temporarily stopped. Then, as illustrated in FIG. 4C, the registration roller pair 20 is rotated at a predetermined timing and the rotation of the sheet feed roller 16 is restarted simultaneously, so that the sheet P1 is conveyed downstream. The sheet feed operation up to this point is the same as in the normal sheet feed operation.

Figure 4D:
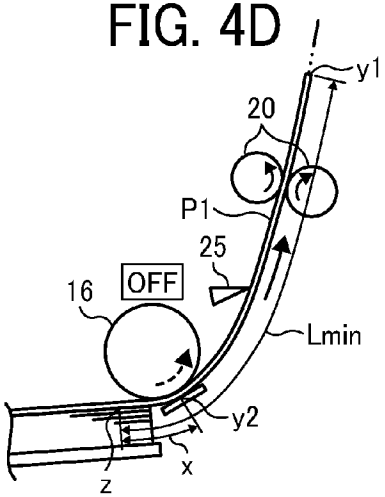

Then, the sheet P1 is conveyed by the sheet feed roller 16 and the registration roller pair 20 as illustrated in FIG. 4D, and at a time before a length Lmin of a settable minimum-sized sheet in the sheet conveyance direction passes through the sheet feed roller 16, driving of the sheet feed roller 16 is stopped.

Specifically, as illustrated in FIG. 4D, when a trailing end of the settable minimum-sized sheet is set to "z", at a time when a portion y2 which is moved by an allowance "x" toward a front side than the trailing end z of the minimum-sized sheet has reached the sheet feed roller 16, driving of the sheet feed roller 16 is stopped. For example, when a settable minimum-sized sheet is A6, the length Lmin in the sheet conveyance direction is set to 148 mm and the allowance x is set to 10 mm. In this case, at a time when the sheet feed roller 16 has fed the sheet by a length of 138 mm is once stopped minus 10 mm as the allowance from the length of the A6-sized sheet in the conveyance direction (148 mm) from the leading end of the sheet P1, the sheet feed roller 16 is stopped.

In the present embodiment, the timing at which the driving of the sheet feed roller 16 is stopped, that is, the timing of the second OFF of the sheet feed roller 16, is controlled by setting a time Tx based on the start of the driving of the registration roller pair 20 set as a trigger as illustrated in FIG. 6. The time Tx is obtained as follows: Assuming that a time period from a first time of the sheet feed roller ON to a first time of the sheet feed roller OFF is set to T2, a conveyance time of the allowance x and the time T2 are subtracted from the conveyance time to be taken for conveying the length Lmin of the minimum-sized sheet in the conveyance direction. That is, Tx=(Conveyance time for Lmin)−(Conveyance time for allowance x)−T2.) Herein, the conveyance time of the length Lmin of the minimum-sized sheet in the conveyance direction does not include a waiting time in which the leading end of the sheet abuts the registration roller pair 20 and is held there.

As described above, although the driving of the sheet feed roller 16 is temporarily stopped before the sheet feed roller 16 has been conveyed the length Lmin of the minimum-sized sheet in the conveyance direction, because the registration roller pair 20 continues driving, the sheet P1 is further conveyed downstream. In this case, because the sheet feed roller 16 is in a rotatable state even when stopped, the sheet feed roller 16 is driven to rotate accompanied by the conveyance of the sheet P1.

Figure 4E:
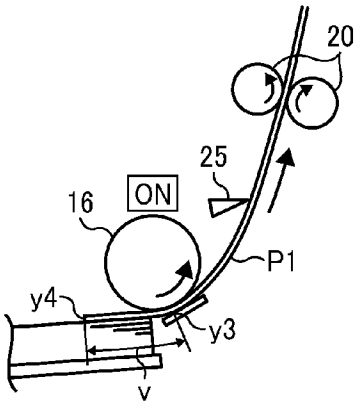
Figure 4F:
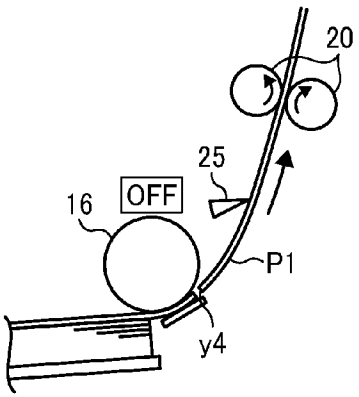

Thereafter, as illustrated in FIG. 4E, when the trailing end y4 of the conveyed sheet P1 reaches the sheet feed roller 16, before the trailing end y4 passes through the sheet feed roller 16, driving of the sheet feed roller 16 is restarted. Specifically, at a time when a portion y3 which is moved by a predetermined length "v" toward a front side than the trailing end y4 of the sheet P1 has reached the sheet feed roller 16, driving of the sheet feed roller 16 restarted. Then, the sheet P1 is conveyed for a while by the driving sheet feed roller 16 and registration roller pair 20. Then, as illustrated in FIG. 4F, at a time when the trailing end y4 of the sheet P1 passes through the sheet feed roller 16, that is, when the sheet feed roller 16 has conveyed the sheet P1 the length of the sheet size in the conveyance direction corresponding to the input image data, driving of the sheet feed roller 16 is stopped.

Thereafter, although not illustrated in FIG. 4, whether or not a conveyance malfunction has occurred is determined based on the sheet trailing end detection timing by the registration sensor 25 (see FIG. 2E).

Successively, with reference to FIGS. 5A to 5G and FIG. 6, a sheet feed operation when a different-size sheet is set will be described.

The timing chart in FIG. 6 is also applied to the ON/OFF control of the sheet feed roller and the registration roller pair in the sheet feed operation when the different-side sheet is set similarly to the case of the correct-size sheet is set. Specifically, in the sheet feed operation preventing continuous feeding of the erroneously-set sheet, driving of each of the sheet feed roller and the registration roller pair is similarly performed regardless of the fact that the sheet size is correctly set or erroneously set.

Figure 5A:
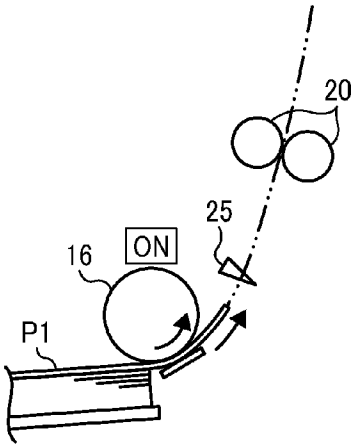
FIGS. 5A to 5G show how a different-size sheet is being fed in the sheet feed operation preventing continuous feeding of the erroneously-set sheet.
Figure 5B:
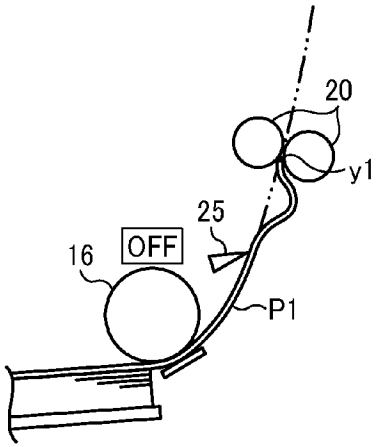
Figure 5C:
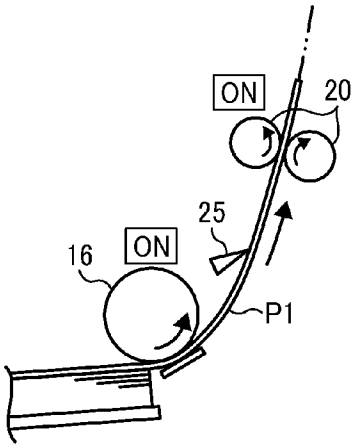

Upon receiving a sheet feed instruction, the sheet feed roller 16 is driven to rotate and a topmost sheet P1 is fed out as illustrated in FIG. 5A. Then, as illustrated in FIG. 5B, a leading end y1 of the fed-out sheet P1 passes through a sensor position of the registration sensor 25, contacts a nip portion of the registration roller pair 20, a bending is formed at the leading edge y1, and a rotation of the sheet feed roller 16 is temporarily stopped. Then, as illustrated in FIG. 5C, the registration roller pair 20 is rotated at a predetermined timing and the rotation of the sheet feed roller 16 is restarted simultaneously, so that the sheet P1 is conveyed downstream.

Figure 5D:
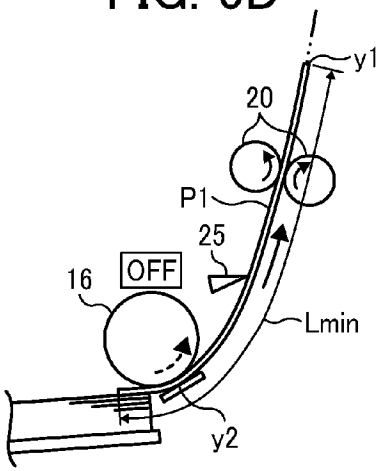

Then, the sheet P1 is conveyed by the sheet feed roller 16 and the registration roller pair 20 as illustrated in FIG. 5D, and at a time before a length Lmin of a settable minimum-sized sheet in the sheet conveyance direction passes through the sheet feed roller 16, driving of the sheet feed roller 16 is stopped. In this case, driving of the sheet feed roller 16 is stopped at a time when the sheet P1 reaches a position y2 similarly to the case in which the correct-size sheet is set (see FIG. 4D).

Then, the sheet P1 is further conveyed toward downstream by the registration roller pair 20. In this case, because the sheet feed roller 16 is in a rotatable state even when stopped, the sheet feed roller 16 is driven to rotate accompanied by the conveyance of the sheet P1.

Figure 5E:
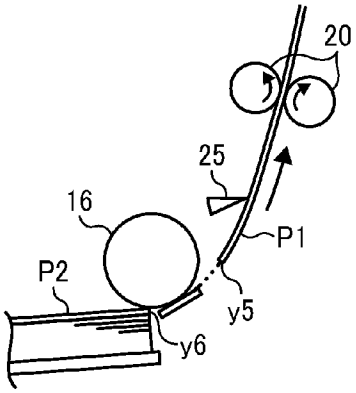

As illustrated in FIG. 5E, because the driven rotation of the sheet feed roller 16 stops at the time when a trailing end y5 of the sheet P1 passes through the sheet feed roller 16, there occurs a gap of sheets between the trailing end y5 of a first sheet P1 and a leading end y6 of a second sheet P2.

Figure 5F:
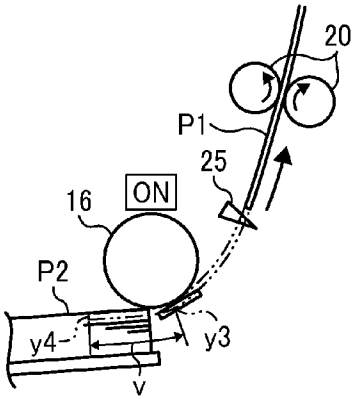

Thereafter, as illustrated in FIG. 5F, the rotation of the sheet feed roller 16 is restarted at a predetermined timing. Specifically, at an assumed timing when the portion y3 which is moved by a predetermined length "v" toward a front side than the trailing end y4 of the sheet of the correct size (that is, the sheet size corresponding to the input image data) has reached the sheet feed roller 16, driving of the sheet feed roller 16 is restarted. Due to a restart of the sheet feed roller 16, feeding of the second sheet P1 is started.

Figure 5G:
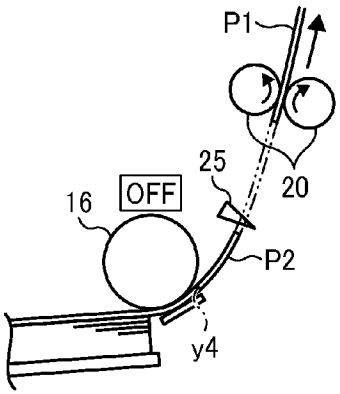

Thereafter, as illustrated in FIG. 5G, at an assumed timing when the trailing end y4 of the correct-size sheet passes through the sheet feed roller 16, that is, when the sheet feed roller 16 has conveyed the sheet the length of the sheet size in the conveyance direction corresponding to the input image data, driving of the sheet feed roller 16 is stopped. Due to stopping of the sheet feed roller 16, feeding of the second sheet P2 is also stopped.

As described above, because a gap between sheets may be formed between the trailing end y5 of the first sheet P1 and the leading end y6 of the second sheet P2 (see FIG. 5E), continuous conveyance of the two erroneously-set sheets can be prevented. Thus, occurrence of any inconvenience such as winding of the second sheet conveyed to the fixing device around the fixing roller can be prevented.

In addition, because a gap between sheets is formed between the trailing end y5 of the first sheet P1 and the leading end y6 of the second sheet P2, the registration sensor 25 can detect the trailing end of the first sheet P1. Accordingly, based on the detected timing of the trailing end, the controller can obtain by calculation the length of the conveyed sheet in the conveyance direction. As a result, if it is detected that the conveyed sheet size is shorter than the to-be-set size, the controller stops conveyance of the sheet and causes a control panel to indicate a malfunction, thereby preventing an erroneously-set size of the sheet from being conveyed.

In FIGS. 5A to 5G, a case in which the mis-set sheet size is the minimum size is represented as an example. However, even in a case in which the mis-set sheet size is shorter than the to-be-set sheet size and longer than the minimum size, the continuous conveyance can be similarly prevented. In the above case, however, because at a time when the driving of the sheet feed roller 16 as illustrated in FIG. 5D is temporarily stopped, part of the length of the sheet remaining upstream of the sheet feed roller 16 in the conveyance direction increases, the gap between the first sheet P1 and the second sheet P2 becomes shorter as illustrated in FIG. 5E.

In addition, in FIG. 4E or 5F, the reason why the sheet feed roller 16 is restarted is to prevent occurrence of stripe-shaped uneven density on the image, which is so-called shock jitter. Shock jitter occurs while the image is being printed on the sheet when the conveyance speed of the sheet is momentarily decreased. Supposing that the sheet feed roller is not driven again in the state as illustrated in FIG. 4E, the sheet feed roller is driven to rotate accompanied by the conveying sheet. In this case, when the trailing end of the sheet passes through the leading end of the sheet bundle stacked on the sheet feed cassette, because the leading end of the sheet bundle pressed by the bottom plate contacts the sheet feed roller, the sheet feed roller receives a load, thereby momentarily decreasing the conveyance speed of the sheet.

In particular, when the trailing end of the last sheet passes through the sheet feed roller and the bottom plate, because the bottom plate directly contacts the sheet feed roller, generating a large load to the sheet feed roller. In addition, a pad member having a high friction coefficient is generally disposed on a surface of the bottom plate. Accordingly, when the pad member directly contacts the sheet feed roller, a large load is generated to the sheet feed roller, which may cause shock jitter to occur.

To prevent shock jitter as described above, it is preferred that the sheet feed roller be again driven before the trailing end of the sheet passes through the nip portion between the sheet feed roller and the bottom plate and a load is applied to the sheet feed roller. Then, in the sheet feed operation according to one embodiment of the present invention, driving of the sheet feed roller 16 is restarted before the trailing end y4 of the sheet P1 passes through the sheet feed roller 16 as illustrated in FIG. 4E. According to this, a momentary decrease of the rotation speed of the sheet feed roller can be prevented, thereby enabling to prevent occurrence of shock jitter.

As another problem, when the sheet feed roller 16 is driven to rotate accompanied by the sheet P1 as illustrated in FIG. 4D, a conveyance load applied to the sheet increases, and due to the conveyance load, image failure occurs such that the formed image on the sheet shrinks along the sheet conveyance direction.

To prevent such an image failure, it is preferred that the time period in which the sheet feed roller is driven accompanied by the sheet be shortened as much as possible. Specifically, by making the timing to restart driving of the sheet feed roller 16 earlier (see FIG. 4E), the driven rotation time can be shortened.

However, when the timing to restart driving of the sheet feed roller 16 is made earlier (see FIG. 4E), the gap between the first sheet P1 and the second sheet P2 is shortened (See FIG. 5F). As a result, when the gap is lost or the gap between sheets becomes shorter than an interval that the registration sensor 25 can detect, no error can be indicated on the control panel. Further, if the length of the sheet in the conveyance direction corresponding to the leading end of the first sheet to the trailing end of the second sheet is below the length of the sheet as the determination basis of a conveyance malfunction (that is, the length L1 of the sheet in the sheet conveyance direction plus the allowance length Lj as illustrated in FIG. 2E), it is not determined that a conveyance malfunction has occurred and the sheet conveyance is not stopped. In this case, there is a concern that the second sheet is conveyed to the fixing device and is wound over the fixing roller.

Accordingly, the timing to restart driving of the sheet feed roller as illustrated in FIG. 4E or 5F needs to be set such that, even though the gap between the first sheet and the second sheet is not detected by the registration sensor 25, before the second sheet reaches the fixing nip of the fixing device being the image fixing position, a conveyance malfunction is detected and the sheet conveyance is stopped.

Figure 7:
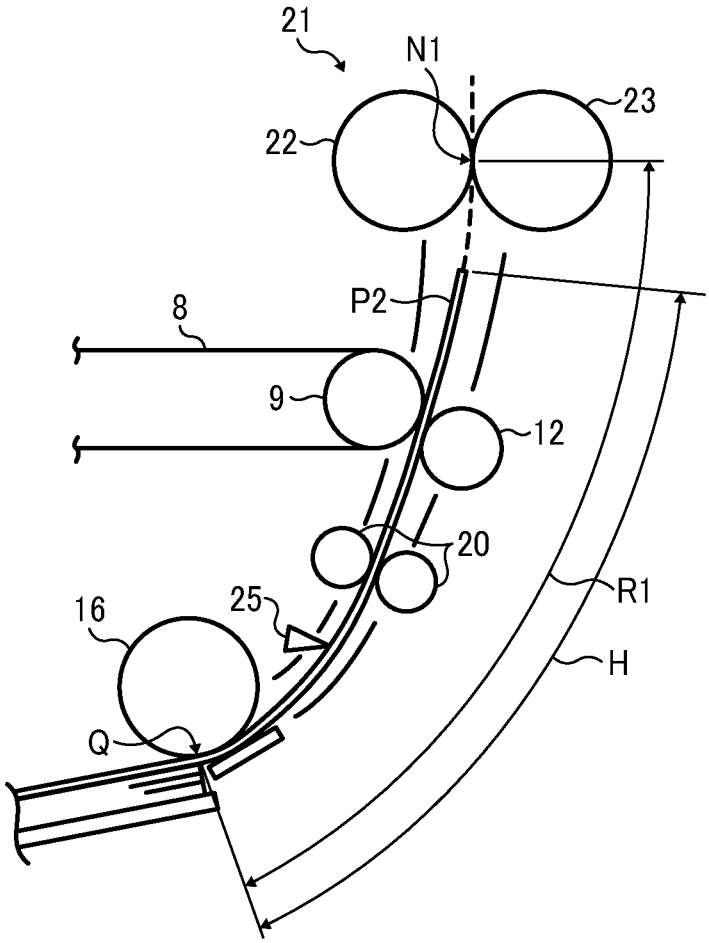
FIG. 7 is a view illustrating how to set a re-drive timing of the sheet feed roller.

Specifically, as illustrated in FIG. 7, assuming that the conveyance distance of the second sheet P2 until a conveyance malfunction is detected and the sheet conveyance is stopped is set to H, and that the sheet conveyance distance from the leading end position Q of the sheet before the sheet conveyance starts to the fixing nip N1 of the fixing device 21 is set to R1, the timing to restart driving of the sheet feed roller 16 is set so that H is shorter than R1 (H<R1). By so doing, before the leading end of the second sheet P2 reaches the fixing nip N1, whether or not a conveyance malfunction has occurred is determined and the conveyance is stopped, thereby preventing the second sheet P2 from winding around the fixing roller 22.

In addition, because the conveyance distance H as illustrated in FIG. 7 is the sheet conveyance distance from the timing to restart driving of the sheet feed roller until a conveyance malfunction is determined and sheet conveyance is stopped, it corresponds to a conveyance distance in the time Th from the timing of the third time of the sheet feed roller ON until the conveyance is stopped due to a conveyance malfunction determination as illustrated in FIG. 6. Herein, assuming that the time from a third time of the sheet feed roller ON until the leading end of the second sheet reaches the fixing nip is set to T4, by setting the timing of the third time of the sheet feed roller ON so as to satisfy an inequality Th<T4, before the leading end of the second sheet reaches the fixing nip, the conveyance can be stopped.

In FIG. 6, assuming that the time from the third time of the sheet feed roller ON to the third time of the sheet feed roller OFF is set to Ty, a preset time taken to determine a conveyance malfunction is set to Tj, and the time from the first time of the sheet feed roller ON to the first time of the sheet feed roller OFF is set to T2, the time Th can be represented by the following formula (1):

$$Th=Tj-(L1-T2)+Ty \quad (1),$$

wherein L1 is the length of the size of the sheet in the conveyance direction corresponding to the input image data. Further, Ty is represented by the following inequality (2) so that the above formula (1) satisfies the inequality of Th<T4:

$$Ty<T4-\{Tj-(L1-T2)\} \quad (2)$$

Specifically, if Ty is set such that the relation represented in the formula (2) is satisfied, a conveyance malfunction can be determined before the leading end of the second sheet reaches the fixing nip and the sheet conveyance can be stopped.

FIG. 8 is another timing chart different from the one illustrated in FIG. 6.

In the timing chart as illustrated in FIG. 6, the third time of the sheet feed roller ON is set such that the conveyance can be stopped before the leading end of the second sheet reaches the fixing nip. In contrast, in FIG. 8, the third time of the sheet feed roller ON is set such that the conveyance can be stopped before the leading end of the second sheet reaches the secondary transfer nip.

Figure 9:
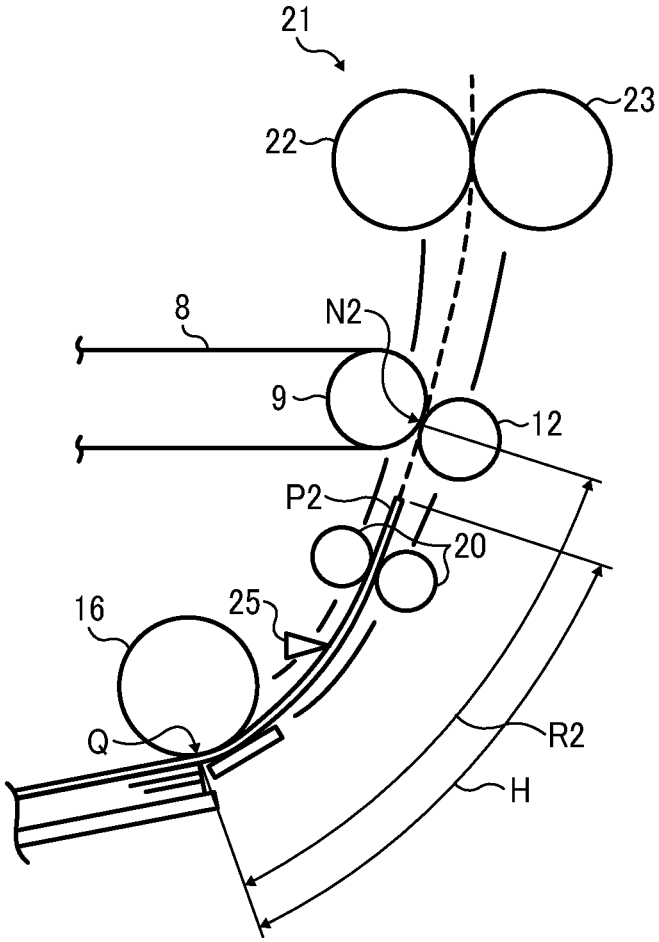
FIG. 9 is a view illustrating how to set the re-drive timing of the sheet feed roller.

Specifically, as illustrated in FIG. 9, assuming that the conveyance distance of the second sheet P2 until a conveyance malfunction is detected and the sheet conveyance is stopped is set to H, and that the sheet conveyance distance from the leading end position Q of the sheet before the sheet conveyance starts to the secondary transfer nip N2 is set to R2, the timing to restart driving of the sheet feed roller 16 is set so H is shorter than R2 (H<R2).

By setting the timing to restart driving of the sheet feed roller 16 as such, the conveyance can be stopped before the leading end of the second sheet P2 reaches the secondary transfer nip N2. As a result, that the conveyance is stopped in a state in which the second sheet P2 is sandwiched by the secondary transfer nip N2 can be prevented. In this case, the user need not remove the sheet sandwiched by the secondary transfer nip, thereby improving operability. Further, the user is excluded from any concern during the sheet removing operation such as smears or contamination of hands or clothes due to the unfixed toner transferred to the sheet.

However, in the case represented in the timing chart of FIG. 8 compared to the case of FIG. 6, because the timing to restart driving of the sheet feed roller (that is, the third time of the sheet feed roller ON) is delayed, the driven rotation time of the sheet feed roller is lengthened, and therefore, the image to be formed on the sheet tends to be shrunk slightly along the sheet conveyance direction.

Further, in this case, by setting the time Ty of FIG. 8 so as to satisfy a following formula (3), a conveyance malfunction can be detected before the leading end of the second sheet reaches the secondary transfer nip:

$$Ty<T3-\{Tj-(L1-T2)\} \quad (3)$$

In the formula (3), T3 is a time period from the third time of the sheet feed roller ON until the leading end of the second sheet reaches the secondary transfer nip. Other numerals in the formula (3) are the same as those in the formula (2), and therefore, the description thereof is omitted.

FIG. 10 is yet another timing chart different from either of the timing charts illustrated in FIG. 6 or 8. In this case, the timing to restart driving of the sheet feed roller (that is, the timing of the third time of the sheet feed roller ON) is set such that a conveyance malfunction can be determined and the conveyance is stopped before the second sheet reaches the sheet detection position of the registration sensor.

Figure 11:
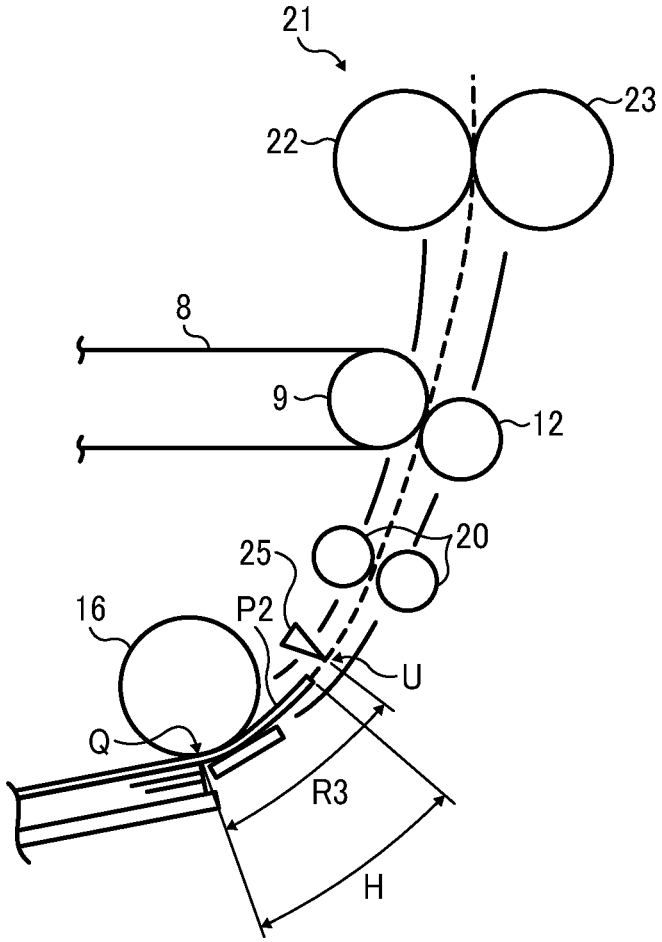
FIG. 11 is a view illustrating how to set the re-drive timing of the sheet feed roller.

Specifically, as illustrated in FIG. 11, assuming that the conveyance distance of the second sheet P2 until the conveyance is stopped due to the determination of a conveyance malfunction is set to H, and that the sheet conveyance distance from the leading end position Q of the sheet before starting sheet feeding to the sheet detection position U of the registration sensor 25 is set to R3, the timing to restart driving of the sheet feed roller is set to satisfy the relation H<R3.

By setting the timing to restart driving of the sheet feed roller 16 as such, a conveyance malfunction can be determined and the conveyance can be stopped before the leading end of the second sheet P2 reaches the registration sensor 25. According to this, because the second sheet is not detected by the registration sensor when the conveyance is stopped, if there is no problem to pass the erroneously-set sheet continuously, the later sheet can be continuously conveyed. As illustrated in FIG. 5G, although the sheet conveyance is started in a state in which the leading end of the second sheet P2 is moved downstream of the sheet feed roller 16, the leading end of the sheet P2 is not detected by the registration sensor 25 at that time. Accordingly, by the successive sheet feeding, the leading end of the sheet P2 can be detected and there will be no problem in the sheet conveyance.

However, it is to be noted that, because the timing to restart driving of the sheet feed roller (that is, the third time of the sheet feed roller ON) is further delayed in the case represented in the timing chart of FIG. 10 than the case represented in the timing chart of FIG. 8, the driven rotation time of the sheet feed roller is lengthened, and therefore, the image to be formed on the sheet tends to be shrunk slightly along the sheet conveyance direction.

In addition, by setting the relation between Ty and T1 so as to satisfy a following inequality (4), a conveyance malfunction can be determined before the leading end of the second sheet is detected by the registration sensor:

$$Ty<T1 \quad (4)$$

In the above inequality (4), Ty is a time period from the third time of the sheet feed roller ON to the third time of the sheet feed roller OFF as described above and T1 is a time period from the first time of the sheet feed roller ON until the leading end of the sheet reaches the registration sensor.

Figure 12:
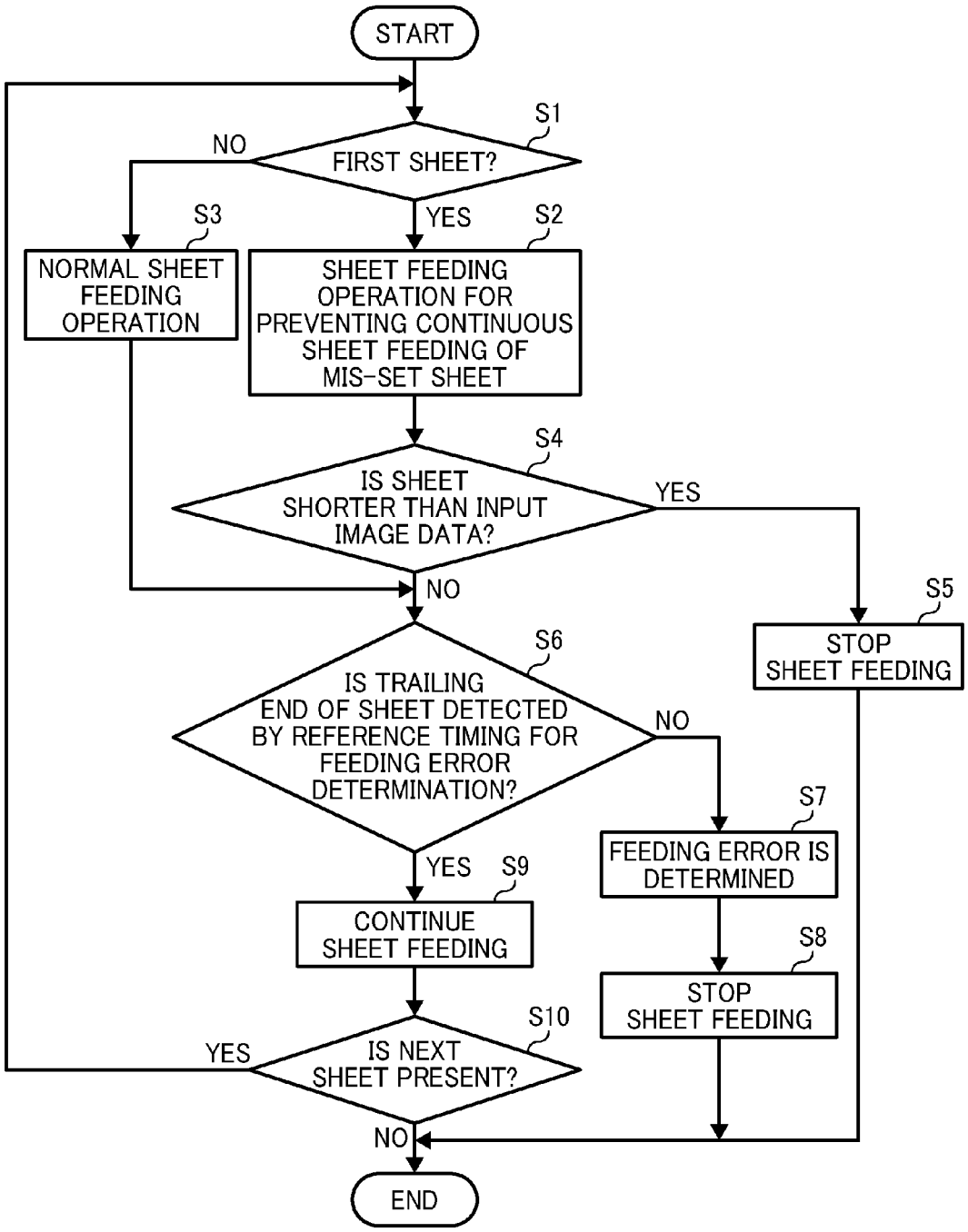
FIG. 12 is a flowchart of the sheet feed operation according to one embodiment of the present invention.

FIG. 12 is a flowchart of the sheet feed operation according to a first embodiment of the present invention.

Because the sheets contained in any given sheet feed cassette are normally all the same size, whether the size of the conveyed sheet is of the to-be-originally-set sheet or not can be confirmed by the size of the first sheet. Accordingly, if the size of the first sheet is determined to be coincident to the to-be-set sheet size, no sheet feeding operation preventing the continuous sheet feeding of the erroneously-set sheet as illustrated in FIG. 6, 8, or 10 is necessary. In addition, differently from the normal sheet feed operation as illustrated in FIG. 3, the sheet feed roller is driven to rotate accompanied by the conveyed sheet in the sheet feed operation as illustrated in FIG. 6, 8 or 10. Such a sheet feed operation is not preferred because an unnecessary conveyance load is generated. Then, in a flowchart as illustrated in FIG. 12, the sheet after the second sheet is controlled to be conveyed according to the normal sheet feed operation not causing an unnecessary conveyance load.

The sheet feed operation as illustrated in FIG. 12 will be described. Upon receiving an instruction to start a sheet feed operation, first, whether the fed sheet is a first sheet or not is determined in step S1. If the fed sheet is the first sheet, a sheet feed operation for preventing continuous feeding of the erroneously-set sheet as illustrated in FIG. 6, 8, or 10 is performed in step S2. By contrast, if the fed sheet is the second or later sheet, a normal sheet feed operation as illustrated in FIG. 3 is performed in step S3.

If the sheet is the first sheet, whether or not the length of the sheet in the conveyance direction is shorter than the sheet size in the conveyance direction corresponding to input image data in step S4. The controller can obtain by calculation the length of the conveyed sheet in the conveyance direction based on the timing of the trailing end of the sheet detected by the registration sensor.

As a result, if it is determined that the detected length of the sheet in the conveyance direction is shorter than the sheet size in the conveyance direction corresponding to the input image data, that is, the shorter-sized sheet than the to-be-set sheet is conveyed, the conveyance of the sheet is forcibly stopped in step S5. On the other hand, if it is not determined that the detected length of the sheet in the conveyance direction is shorter than the to-be-set sheet size, it is determined whether or not the trailing end of the sheet is detected by the registration sensor before the timing of the determination basis of a conveyance malfunction in step S6.

As a result, if the trailing end of the sheet is not detected before the timing of the determination basis of a conveyance malfunction, it is determined that a conveyance malfunction has occurred such as sheet jamming in step S7, and the sheet feeding is forcibly stopped in step S8. In addition, a conveyance malfunction determination by detecting the trailing end of the sheet is performed similarly as to the second and later sheets. By contrast, if the trailing end of the sheet is detected before the timing of the determination basis of a conveyance malfunction, it is determined that a conveyance malfunction does not occur and the sheet feeding is continued in step S9.

Then, when the sheet feeding is continued, whether a next sheet is fed or not is confirmed in step S10. When the next sheet is fed, the above sheet feed flow is repeated to a next sheet. If the next sheet is not fed, the sheet feed operation is stopped.

Then, in a flowchart as illustrated in FIG. 12, because the sheet feed operation preventing the continuous feeding of the erroneously-set sheet is performed to only the first sheet, the conveyance load due to a driven rotation of the sheet feed roller in the second and later sheet feeding can be prevented from increasing. Thus, occurrence of the image failure such that the transferred image shrinks along the sheet conveyance direction can be prevented.

In addition, a determination whether the sheet is the first one or not can be performed each time a print instruction is received. However, because the sheet is not replaced or supplied each time when the print instructing is received (that is, there is not always a concern of erroneously setting), it is also recommended that the determination of the first sheet or not can be performed, for example, when the power to the printer is turned on or when the first print instruction is received after the handling of the sheet jam has been processed. With this structure, a number of times to perform the sheet feed operation preventing continuous feeding of the erroneously-set sheet can be reduced, and therefore, the number of times of occurrence of the image failure can be reduced.

Figure 13:
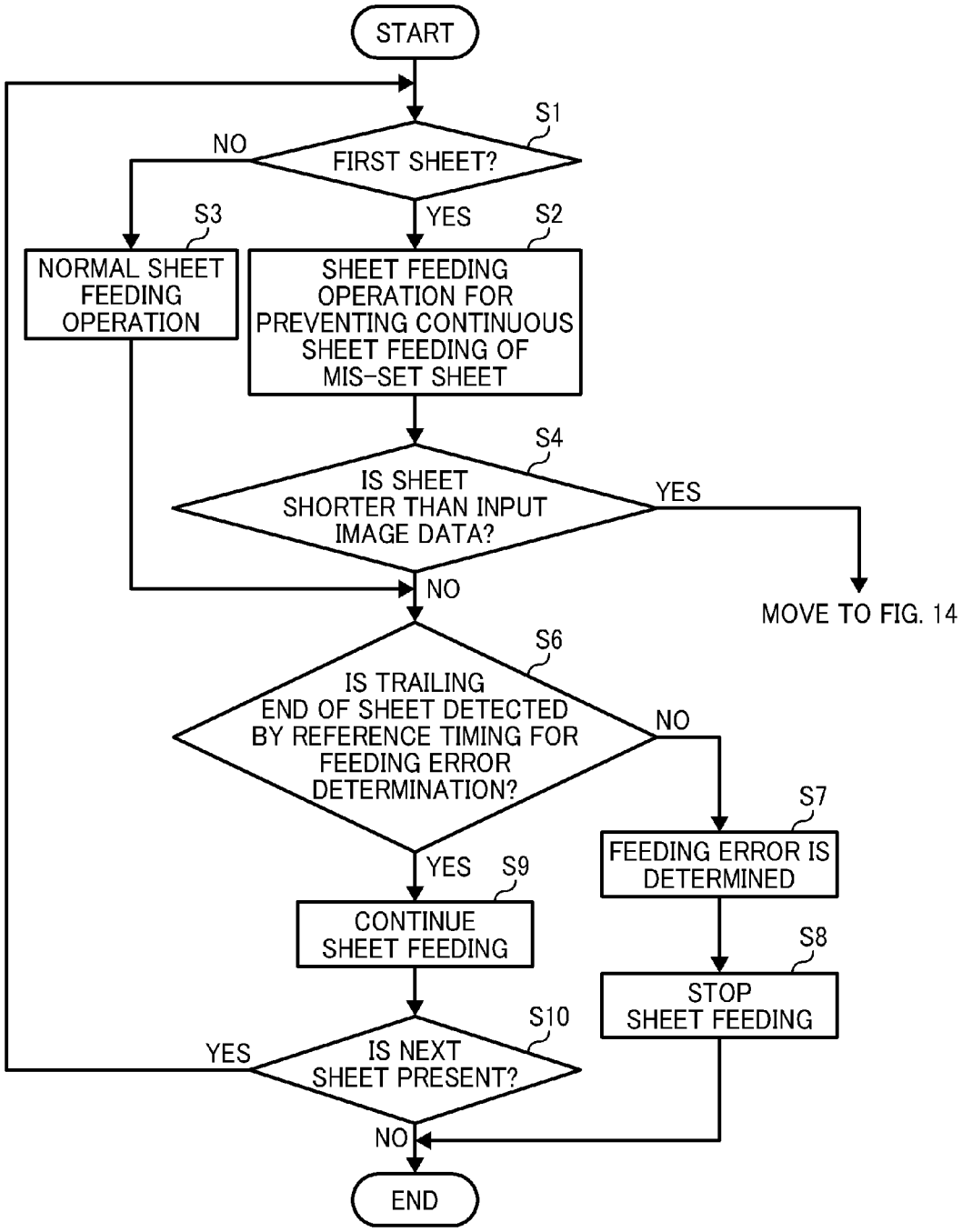
FIG. 13 is a flowchart of the sheet feed operation according to a second embodiment of the present invention.
Figure 14:
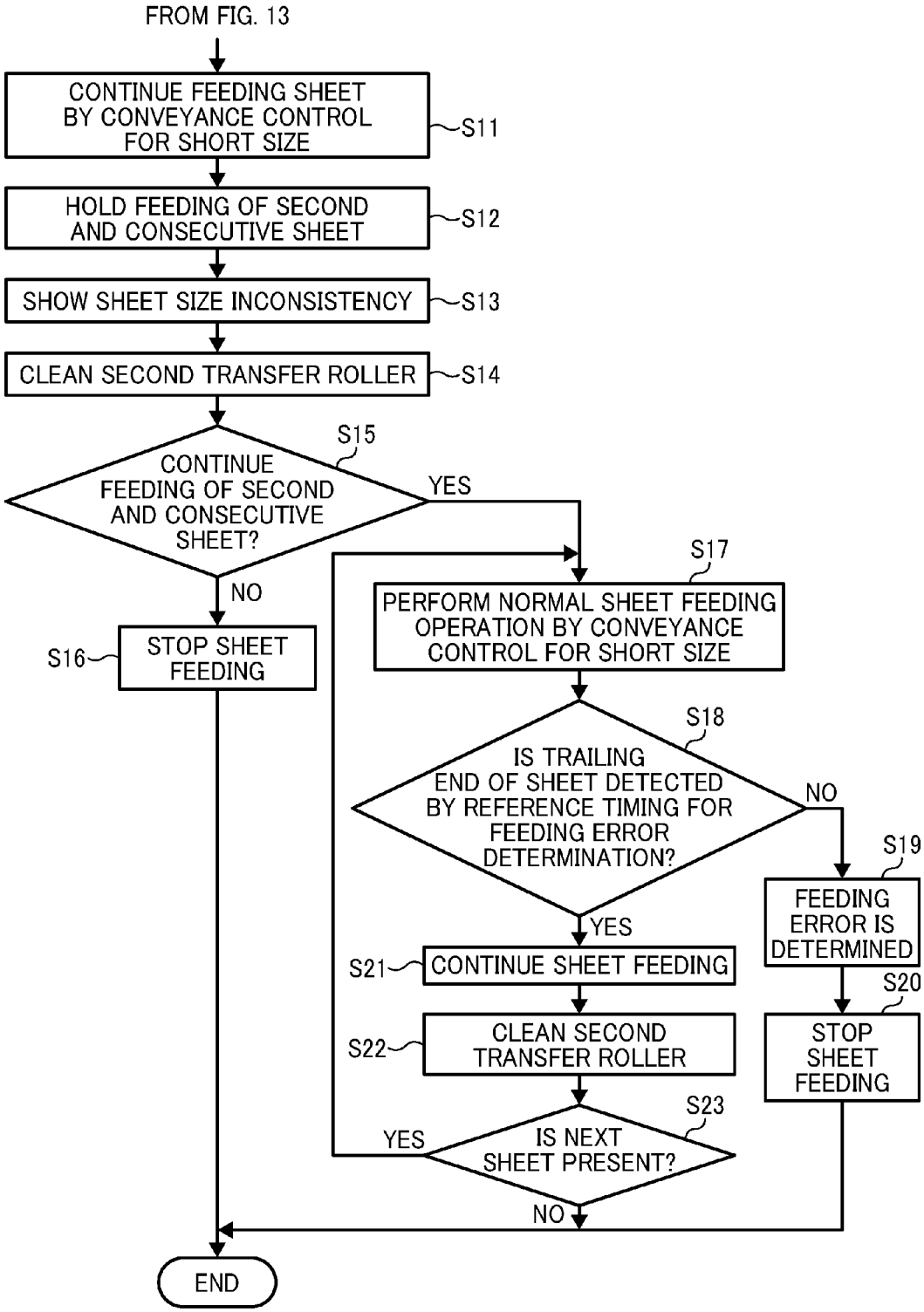
FIG. 14 is a flowchart of the sheet feed operation according to a third embodiment of the present invention.

FIGS. 13 and 14 are flowcharts of the sheet feed operation which is different from the embodiment as illustrated in FIG. 12.

If it is determined that the detected length of the sheet in the conveyance direction is shorter than the sheet size in the conveyance direction corresponding to the input image data, conveyance of the sheet is stopped in the sheet feed flow as illustrated in FIG. 12; however, in the sheet feed flow of FIG. 13, even in such a case, the sheet feeding is not stopped and the first sheet is ejected.

More specifically, if it is determined that the detected length of the sheet in the conveyance direction is shorter than the sheet size in the conveyance direction corresponding to the input image data, the process moves to the sheet feed flow of FIG. 14. Then, the conveyance control is changed based on the length of the sheet in the conveyance direction calculated by the detection data of the registration sensor, and the first sheet is continued to be fed in step S11. Herein, the change of the conveyance control means that the timing of the determination basis for a conveyance malfunction is changed from the timing based on the sheet size corresponding to the input image data to the timing of the detected shorter-sized sheet. On the other hand, feeding of the second and later sheets is waited in step S12.

The first sheet of which feeding is continued is conveyed to the secondary transfer nip and on which the toner image is transferred. Thereafter, the transferred toner image is fixed at the fixing device, and the first sheet is ejected outside the apparatus.

In this case, that the sheet size is not coincident is displayed on the control panel disposed on the printer body in step S13; so that the user notices that the image is formed on the size of the sheet different from the desired sheet size corresponding to the input image data.

When the toner image is transferred to the above shorter-sized sheet, the toner not transferred to the sheet may deposit on the secondary transfer roller 12 (see FIG. 1). In such a state, when the next sheet is printed, the toner deposited on the secondary transfer roller may disperse inside the apparatus or on a next sheet, which may cause an interior of the apparatus to be contaminated or occurrence of an abnormal image on the next sheet. Then, after the toner image has been transferred to the first sheet, the secondary transfer roller is cleaned by a transfer cleaning means in step S14. With this structure, occurrence of the image failure on the next and later sheets can be prevented.

As to whether the sheet feeding of the second and later sheets which are in the waiting mode is continued or not is selected and determined by the user with the control panel disposed on the printer body in step S15. If the user determines not to continue sheet feeding of the second and later sheets, the sheet feeding operation is terminated (in step S16). If the user determines to continue sheet feeding of the second and later sheets, the sheet feeding control is changed to the control based on the shorter sheet size similar to the case of the first sheet, and the second sheet feeding is started in the normal sheet feed operation (in step S17).

Then, determination of a conveyance malfunction by the trailing end of the sheet is performed as to the second sheet as in the above process (in step S18). If it is determined that a conveyance malfunction has occurred (in step S19), the sheet feeding is forcibly stopped (in step S20). On the other hand, if it is not determined that a conveyance malfunction has occurred, the sheet feeding is continued (in step S21), and after the transfer and fixation of the toner image is performed to the second sheet, the sheet is ejected outside the apparatus.

Also in this case, because the toner that could not be transferred to the second sheet may attach to the secondary transfer roller, after the toner image has been transferred to the second sheet, the secondary transfer roller is cleaned by the transfer cleaning means in step S22.

Then, whether a next sheet is fed or not is confirmed in step S23, and when the next fed sheet exists, the sheet feed flow similar to the flow for the second sheet is performed to the third and later sheets. When there is no more fed sheet, the sheet feed operation is terminated.

The sheet feed flow in FIGS. 13 and 14 is the same as that illustrated in FIG. 12 excluding the flow described above, and the description of the same flow is omitted.

As described above, in the sheet feed operation as illustrated in FIGS. 13 and 14, differently from the sheet feed operation as illustrated in FIG. 12, even though the first sheet is determined to be a shorter size than the original sheet size, the sheet feeding is not stopped and the first sheet is continued to be conveyed and then ejected. With this structure, the user need not remove the sheet in the case in which the conveyance of the sheet is forcibly stopped, thereby improving the operability.

Also in this case, similarly to the case of sheet feed operation as illustrated in FIG. 12, because the sheet feed operation preventing the continuous feeding of the erroneously-set sheet is performed only to the first sheet, occurrence of the image failure such that the image shrinks along the sheet conveyance direction in the second and later sheets can be prevented.

As described above, according to the present invention, the sheet feed roller 16 starts driving to feed the sheet and the driving of the sheet feed roller 16 is stopped before the sheet feed roller 16 has completed feeding a length Lmin of the settable minimum-sized sheet in the conveyance direction. Therefore, even though the actually set sheet is different from the size of sheet to be originally set, continuous feeding of the erroneously-set sheet is prevented from occurring.

Moreover, in the present invention, the size of the erroneously-set sheet for which continuous feeding can be prevented has no limitation. Accordingly, when the length in the conveyance direction of the erroneously set sheet is longer than half that of the sheet to be originally set, continuous feeding of the erroneously-set sheet can be prevented.

For example, in a case in which the image forming apparatus does not include any detection means such as a side fence to detect a width of the sheet, such an erroneous setting that the actually set sheet is longer than the half of the to-be-set sheet originally tends to occur. In particular, by applying the present invention to the image forming apparatus as such, continuous feeding of the erroneously set sheet may be exerted, thereby improving reliability. Namely, by applying the present invention, a detection means such as a side fence to detect a width of the sheet need not be provided, thereby achieving a smaller apparatus and a lower cost.

In the above-described exemplary embodiments, a color laser printer is used as an example of an image forming apparatus to which the present invention is applied, as illustrated in FIG. 1; however, the present invention is not limited only to this, but may be applied to a monochromatic printer, other types of printers, a copier, a facsimile machine, or a multi-function apparatus combining any of the capabilities of the above devices. The image forming apparatus to which the configuration of the present invention can be applied is not limited to apparatuses employing an electrophotographic method of image formation, and includes an inkjet image forming apparatus in which ink droplets are discharged from nozzles of a recording head to form an image onto the sheet.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image forming unit to form an image on a recording medium;

a registration roller pair to convey the recording medium to the image forming unit;

a sheet feed roller to convey the recording medium to the registration roller pair; and a controller to control driving of the registration roller pair and the sheet feed roller, wherein the controller starts driving of the sheet feed roller to feed the recording medium and stops driving of the sheet feed roller before the sheet feed roller has completed conveyance of the recording medium for a distance equal to a length of a minimum recording medium size that the image forming apparatus can set in a conveyance direction, wherein the timing at which the driving of the sheet feed roller is stopped is controlled by setting a time based on a start of the driving of the registration roller pair set as a trigger, and wherein the driving of the sheet feed roller is stopped and restarted at least twice while the driving of the registration roller pair is performed.

2. An image forming apparatus as claimed in claim 1, wherein the controller restarts driving of the sheet feed roller after the temporarily stopped sheet feed roller has conveyed the recording medium for a distance equal to a length in the conveyance direction of the size of the recording medium corresponding to input image data and before the driving of the sheet feed roller is stopped.

3. An image forming apparatus as claimed in claim 1, further comprising a registration sensor provided between the registration roller pair and the sheet feed roller to detect the recording medium in a conveyance path between the sheet feed roller and the registration roller pair, wherein the controller is configured to:

determine that there is a recording medium conveyance malfunction when the registration sensor does not detect a trailing end of the recording medium before lapse of a predetermined time set based on the length of the size of the recording medium in the conveyance direction corresponding to the input image data, the predetermined time starting from a driving start time of the sheet feed roller or from a later predetermined timing; and stop conveyance of the recording medium.

4. An image forming apparatus as claimed in claim 3, further comprising a fixing device to fix an image formed on the recording medium by the image forming unit, wherein a timing to restart driving of the sheet feed roller is set such that the conveyance distance of the recording medium from when the sheet feed roller restarts driving until driving of the sheet feed roller is stopped due to determination of the conveyance malfunction is shorter than the conveyance distance of the recording medium from a leading end of the recording medium before being fed to a position of image fixation in the fixing device.

5. An image forming apparatus as claimed in claim 3, further comprising a fixing device to fix an image formed on the recording medium by the image forming unit, wherein a timing to restart driving of the sheet feed roller is set such that the conveyance distance of the recording medium from when the sheet feed roller restarts driving until driving of the sheet feed roller is stopped due to determination of the conveyance malfunction is shorter than the conveyance distance of the recording medium from a leading end of the recording medium before being fed to a position of image formation to the recording medium by the image forming unit.

6. An image forming apparatus as claimed in claim 3, further comprising a fixing device to fix an image formed on the recording medium by the image forming unit, wherein a timing to restart driving of the sheet feed roller is set such that the conveyance distance of the recording medium from when the sheet feed roller restarts driving until driving of the sheet feed roller is stopped due to determination of the conveyance malfunction is shorter than the conveyance distance of the recording medium from a leading end of the recording medium before being fed to a position of detection of the recording medium by the registration sensor.

7. An image forming apparatus as claimed in claim 3, wherein the controller is configured to:

determine whether a length of the recording medium obtained based on the detection data by the registration sensor and a length of the size of the recording medium in the conveyance direction corresponding to input image data are coincident or not; and stop conveyance of the recording medium if it is determined that the detected length of the recording medium in the conveyance direction is shorter than the length of the size of the recording medium corresponding to the input image data.

8. An image forming apparatus as claimed in claim 3, wherein the controller is configured to:

determine whether a length of the recording medium obtained based on detection data by the registration sensor and a length of the size of the recording medium in the conveyance direction corresponding to input image data are coincident or not;

control conveyance of the recording medium based on the detected length of the recording medium in the conveyance direction if it is determined that the detected length of the recording medium in the conveyance direction is shorter than the length of the size of the recording medium corresponding to the input image data and cause the recording medium to be ejected outside the apparatus.

9. An image forming apparatus as claimed in claim 8, further comprising:

a transfer unit to transfer a formed image to a recording medium; and a transfer cleaning unit to clean the transfer unit, wherein the controller controls conveyance of a recording medium based on a detected length of the recording medium, controls the transfer unit to transfer an image onto the recording medium, and then controls the transfer cleaning unit to clean the transfer unit.

10. An image forming apparatus as claimed in claim 3, wherein the controller is configured to:

determine whether a length of the recording medium obtained based on detection data by the registration sensor and a length of the size of the recording medium in the conveyance direction corresponding to input image data are coincident or not;

start driving of both the sheet feed roller and the registration roller pair to convey following recording media if it is determined that the detected length of the recording medium in the conveyance direction is coincident with the length of the size of the recording medium corresponding to the input image data; and continue driving of the sheet feed roller until the sheet feed roller completes feeding of the recording medium for a distance equal to a length in the conveyance direction of the recording medium corresponding to the input image data.

* * * * *